US005320260A

United States Patent [19]

Song et al.

[11] Patent Number: 5,320,260

[45] Date of Patent: Jun. 14, 1994

[54] SYRUP DISPENSER

[75] Inventors: John Song, Evanston; Richard W. Hofmann, Chicago; Michael C. Illenberger, Downers Grove, all of Ill.

[73] Assignee: Magenta Corporation, Chicago, Ill.

[21] Appl. No.: 28,392

[22] Filed: Mar. 9, 1993

[51] Int. Cl.[5] ..... B65D 47/40

[52] U.S. Cl. ..... 222/547; 222/570; 222/571

[58] Field of Search ..... 222/109, 460, 462, 544, 222/547, 562, 564, 570, 571

[56] References Cited

U.S. PATENT DOCUMENTS

| | | | |
|---|---|---|---|
| 2,769,583 | 11/1956 | Darlington, Jr. | 222/544 X |
| 3,117,701 | 1/1964 | Stull | 222/571 X |
| 3,910,463 | 10/1975 | Reese | 222/570 X |
| 4,264,022 | 4/1981 | Perné et al. | 222/547 |
| 4,796,769 | 1/1989 | Obadia | 222/547 X |
| 4,936,498 | 6/1990 | Pirilä222 | 564 X/ |
| 5,141,138 | 8/1992 | Odet et al. | 222/547 X |

FOREIGN PATENT DOCUMENTS

| | | | |
|---|---|---|---|
| 228587 | 3/1959 | Australia | 222/570 |
| 873459 | 7/1961 | United Kingdom | 222/564 |

*Primary Examiner*—Kevin P. Shaver

*Attorney, Agent, or Firm*—Laff, Whitesel, Conte & Saret

[57] ABSTRACT

A dispensing device to be fitted to the top of a container and to be used to dispense heavy or viscous fluid from the container. It is a unitary structure that comprises generally a spout having a fluid passageway, a rod extending through the center of the spout, and a skirt bounding the base of the spout. The rod is joined to the inner wall of the spout by a relatively thin rectangular brace. The rod is generally cylindrical and has chamfered ends. An annular, curved member is formed inside the skirt and extends away from the spout to form a bottomless bowl portion interconnecting the spout passageway to form a continuous fluid passageway. The rod provides additional surface area for the liquid to cling to while it is being dispensed and also delays venting as the container is righted after the desired amount of liquid is dispensed, thereby preventing drippage. In addition, the bottomless bowl prevents clogging because it causes the liquid in the passageway to be pulled back from the spout into the container.

35 Claims, 2 Drawing Sheets

SYRUP DISPENSER

FIELD OF THE INVENTION

The present invention relates to device for dispensing viscous liquids from a container.

BACKGROUND OF THE INVENTION

In general, due to their higher viscosity, it is more difficult to dispense from containers heavy or "viscous" liquids, such as syrup or oil, than lighter liquids such as water. When the container is righted after the desired amount of liquid is dispensed, for example, the viscous liquids tend to drip more than the lighter liquids. This is because the counter-acting pulling forces of the liquid, which together with gravity cause the liquid to separate, also cause turbulence at the point of separation, in turn causing the liquid to separate even more and, thus, drippage. Although dripping in general is undesirable, it becomes even more of a problem in connection with viscous liquids, which tend to be quite sticky and more difficult to clean up than the lighter fluids.

Another problem associated with the dispensing of viscous liquids is that, because of their thickness and tenacity, they tend to clog up the dispensing opening after one or more uses. Accordingly, after the viscous liquid has been dispensed from a container, the liquid tends to cling to the wall of the dispensing opening and dry up, causing clogging. This residue can also present a sanitary risk, especially when the fluid being dispensed is a food product, such as pancake syrup or vegetable oil.

Accordingly, it is an object of this invention to provide a device that dispenses viscous liquids from a container in an efficient manner by preventing drippage. It is a further object of this invention to provide such a device that also prevents clogging of the container opening usually associated with dispensing viscous liquids.

SUMMARY OF THE INVENTION

In accordance with these and other objects, a novel device for dispensing viscous liquids from a container is provided. The device can be used to dispense viscous food products such as syrup, vegetable oil, liqueur or the like, or viscous industrial products such as motor oil, paint or the like.

In its preferred embodiment, the device is adapted to be fitted to the top of the container, and generally comprises a skirt and a cylindrical spout. Disposed within the spout is a rod that extends parallel to the spout from the top of the spout to the bottom side of the skirt. The rod is mounted to the inner wall of the spout by a brace that is generally rectangular and integral with the inner wall and the rod. The skirt, spout and rod are generally concentric.

The rod provides additional surface area to which the liquid clings while the liquid is being dispensed, thereby increasing the ability of the viscous liquid to remain within the spout as the container is righted after the desired amount of liquid has been dispensed. In addition, the rod also delays the venting of the liquid as the container is righted, which enables a clean cut-off of the viscous liquid flow. By varying the dimensions of the spout and rod, the liquid cut-off and anti-drip features can be achieved, regardless of the viscosity of the liquid.

In the preferred embodiment, the skirt comprises two stacked, concentric tiers with the top tier having a smaller diameter than the bottom tier. Each tier comprises an annular rim and a shoulder. The spout is joined to the top of the shoulder of the top tier. In addition, a curved member extends annularly on the bottom of the shoulder of the top tier and into the bottom tier, thereby defining a bottomless bowl that interconnects with the spout passageway to form a continuous fluid passageway. The transition from the spout is accomplished by a curved neck portion having a radius that ranges from about 0.010 inches to about 0.125 inches.

Due to the construction of the bottomless bowl portion, as the container is righted and the viscous liquid passes back down the spout passageway and into the bowl, the liquid extending into the spout is pulled back from the spout into the bowl away from the central rod, thereby preventing the clogging within the spout passageway that is normally associated with dispensing viscous liquids.

In the preferred embodiment, an annular boss is formed on the base of the inner side of the bottom tier of the skirt. Because of the inherent flexibility in the bottom tier, the boss enables the bottom tier to engage the top of a container to form a pressure fit. A flexible annular claw is also formed on the shoulder portion of the bottom tier, extending slightly inwardly.

Engagement of the top of the container with the boss causes the claw to flex upwardly and thereby form a lateral seal with the top of the container rim to prevent fluid from exiting the side of the device.

If desired, a replaceable cap may also be included to cover the spout when liquid is not being dispensed. The cap comprises first and second stacked, concentric tiers. The cap first tier has a smaller radius and is adapted to be disposed about the spout, and the cap bottom tier is adapted to be disposed about the dispenser two-tiered skirt. An internal thread is provided within the bottom cap tier, which is adapted for screwing onto an external thread provided near the top of the container. In addition, an annular recess is provided near the base of the first tier. This recess is adapted to receive an annular boss formed on the outside of the dispenser.

The present invention and advantages thereof will become more apparent upon consideration of the following detailed description when taken in conjunction with the accompanying drawings.

DETAILED DESCRIPTION OF THE DRAWINGS

Figure 1:
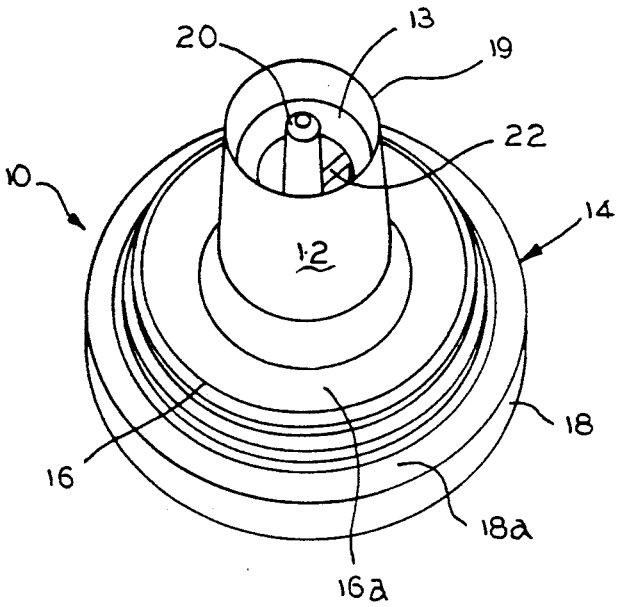
FIG. 1 is a perspective of a closure device in accordance with a preferred embodiment of the invention.
Figure 2:
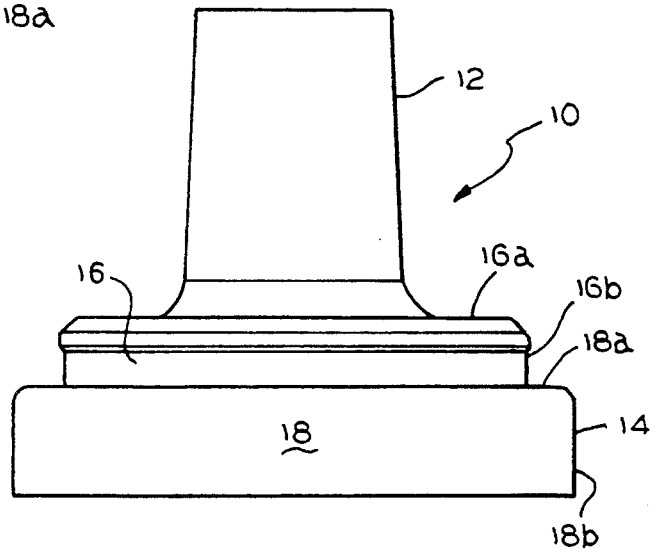
FIG. 2 is a side view of the closure of FIG. 1.
Figure 3:
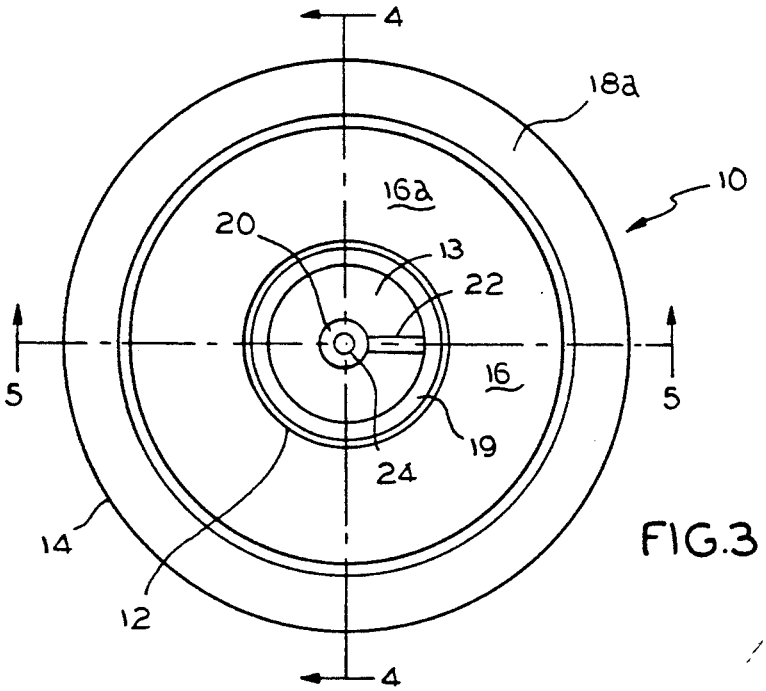
FIG. 3 is a top view of the closure of FIGS. 1 and 2.

FIGS. 1-5 show generally a liquid dispenser 10 adapted to be fitted to the top of a container and used to dispense heavy or "viscous" liquids from the container. The dispenser is specifically constructed to dispense pancake syrup, but it is applicable to other viscous food products such as syrup, vegetable oil, liqueur or the like, or viscous industrial products such as motor oil, paint or the like.

The liquid dispenser 10 is preferably a unitary structure that has a generally cylindrical liquid dispensing spout 12 having a spout passageway 13, and a skirt 14 having top and bottom tiers 16, 18. Top and bottom tiers each comprise a shoulder 16A, 18A respectively bounded by a respective rim 16B, 18B. Spout 12 and tiers 16 and 18 are preferably concentric. The spout is joined to the top of the shoulder 16A of top tier by an annular curved wall, as shown in FIGS. 1–6. A leading edge 19 of the spout is preferably tapered to a sharp edge and preferably has an internal rounded taper to enable a smooth dripless fluid flow.

A rod 20 is disposed within the spout passageway 13, preferably extending parallel and concentric to the spout 12 and skirt 14. As shown best in FIG. 5, the rod 20 is joined to the inside of the spout by opposed longitudinal edges of a single relatively thin brace to minimize obstruction of the spout passageway. The generally rectangular brace is substantially shorter than the length of the rod. The brace is located within the spout passageway 13 with its bottom end 21 adjacent the bottom of the passageway 13. This brace top end 23 is spaced from the top of the passageway 13.

The rod 20 is generally cylindrical except that, in the preferred embodiment, its diameter decreases very slightly from the brace top end 23 to the chamfered end 24 of the rod. This decrease in diameter defines a 1° slope or taper in the surface of the rod. The diameter of the rod also decreases from the brace or bottom 21 to the bottom chamfered end 25 of the rod. This also defines a 1° slope or taper in the surface of the rod. The rod 20 extends from the dispensing end 27 of the spout passageway to, preferably, about two-thirds of the way into the bottom tier. The top and bottom ends 24 and 25 of the rod are each chamfered to shed liquid preferably at an angle of about 45°.

The rod 20 provides additional surface area within the spout 14 passageway 13 for the liquid to cling to when the liquid is being dispensed, and, thus, reducing drippage by increasing the ability of the viscous liquid to remain within the spout 12 as the container is righted after the desired amount off liquid has been poured or dispensed. In addition, the rod 20 also delays the venting of the liquid at the top of the spout as the container is righted, which enables a clean cut-off of the flow of the viscous liquid.

By varying the length and diameter dimensions of the spout 12 and rod 20, the anti-drip and liquid cut-off features can be achieved for liquids of many different viscosities. In our preferred use as a pancake syrup dispenser, the spout passageway 13 has a diameter that ranges from about 0.125 inches to 0.500 inches, and a cross-sectional area that ranges from about 0.015 square inches to about 0.25 square inches. The desired length of the spout 12 increases with higher viscosity liquids. In addition, the surface area of the rod 20 preferably is 20%–30% of the surface area of the inner wall of spout 12. The probable range of ratios of the length of spout 12 to the diameter of spout passageway 13 is from 1:1 to 3:1.

Figure 4:
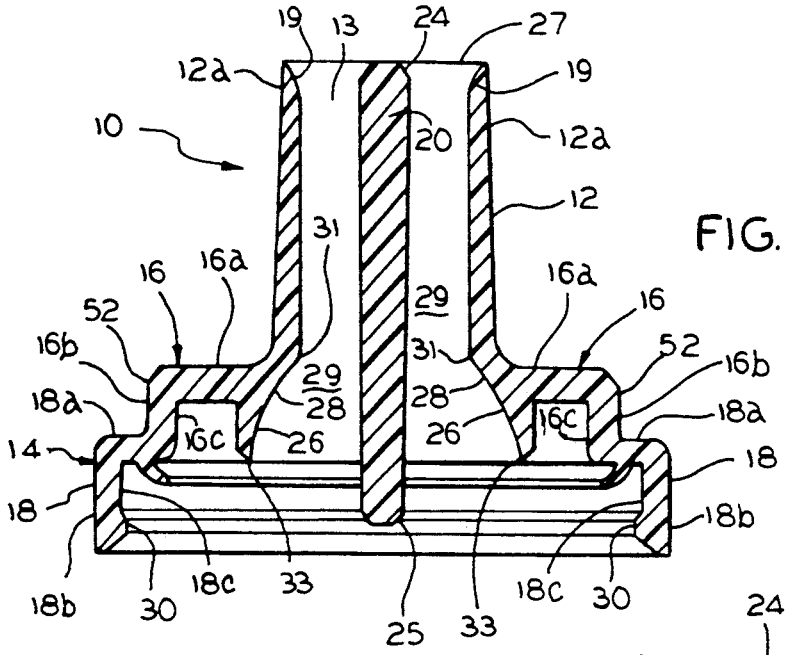
FIG. 4 is a cross section taken along lines 4—4 of FIG. 3.
Figure 5:
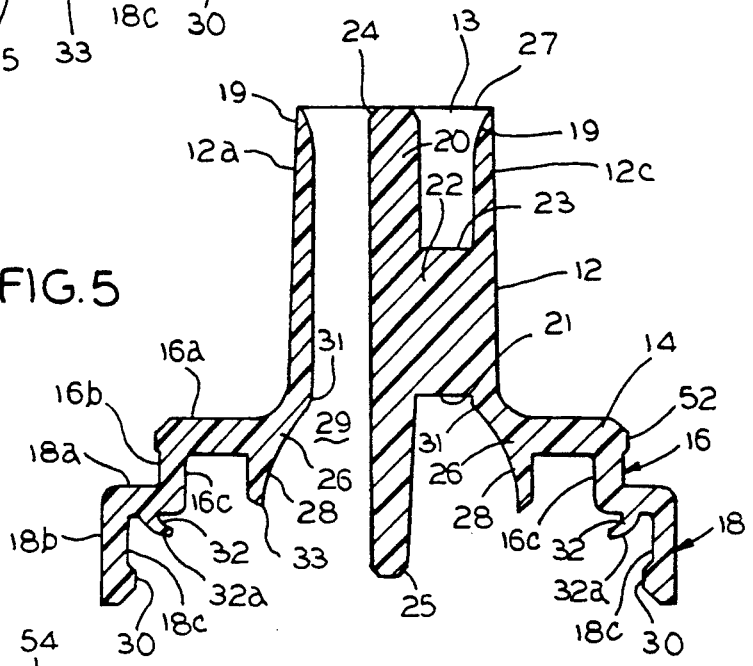
FIG. 5 is a cross section taken along lines 5—5 of FIG. 3.

At the base of the spout passageway 13, a bottomless bowl 26 is formed by an annular curved wall 28 that extends downwardly and outwardly from the bottom of passageway 13. The base of passageway 13 is considered the bottom portion of the bowl 26 as best shown in FIGS. 4 and 5. The bottomless bowl 26 defines a passageway 29 that interconnects with the spout passageway 13. The transition between the bottomless bowl 26 and the spout 12 is by a rounded neck surface 31 having a radius R (see FIG. 4) which is suited to the liquid viscosity and which controls the rate of liquid flow during drain-back. The open end 33 of the bowl 26 ends approximately at the transition between the inner open portions 18c and 16c of the top and bottom tiers. The open end 33 is larger than the base of passageway 13.

Figure 6:
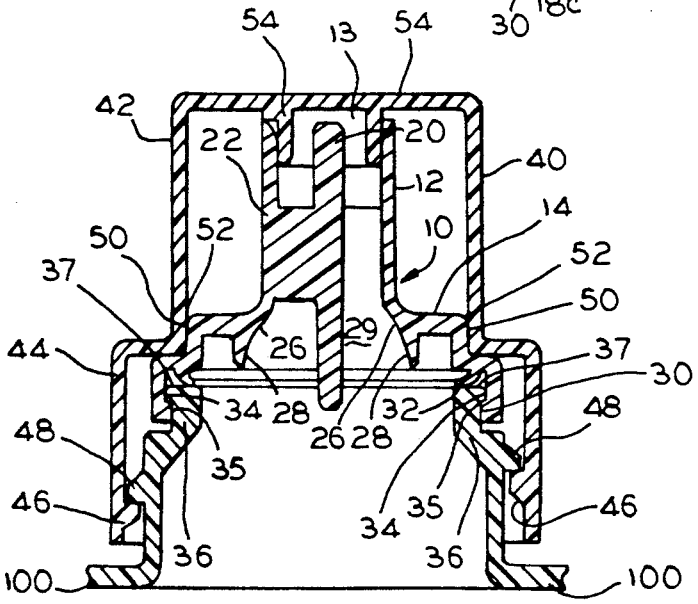
FIG. 6 is a cross section of the closure device of FIGS. 1-5 disposed within a cap used to cover the closure device when it is not in use.

Because of the bottomless bowl 26 formed in the skirt 14, when the container is righted, the viscous liquid passes back down the spout passageway 13, with portions of the liquid flowing on surfaces 31 to surface 28, and into the container 100 (FIG. 6). Due to the configuration of the bottomless bowl 26, the liquid extending into the spout 12 is pulled back from the spout and away from the central rod into the bowl, thereby preventing the clogging of the liquid within the spout passageway 13 that is normally associated with dispensing viscous liquids. Preferably, radius R of the surface 31 is in the range of 0.010 inches to 0.125 inches. Decreasing the radius R reduces the flow rate and in the extreme causes liquid cut-off which leaves residue to clog the spout 10 passageway. An excessively large radius R, on the other hand, encourages rapid drainback prematurely thinning the liquid at the base of the spout 12 and the residue is not withdrawn from passageway 13. Again clogging results. The outside edge of the bottomless bowl is chamfered to prevent clinging of liquid during drainback.

Additionally, in the preferred embodiment, the radius of the bowl 26 is approximately 0.24 to 0.28 inches, and the cross-sectional area of the bottomless bowl 26 taken at its end 33 is approximately 1.5 to 2.5 times the cross-sectional area of the spout passageway 13 taken along lines 12a.

In a preferred embodiment the inner diameter of the spout is approximately 0.32 inches, the radius of the bowl is approximately 0.26 inches, the radius R is approximately 0.05 inches and the top diameter of the rod is approximately 0.085 inches and tapers outwardly to approximately 0.094 inches. The bottom diameter of the rod is approximately 0.073 inches and tapers outwardly to 0.094 inches. The length of the spout as measured from shoulder 16A to the top of the spout is approximately 0.60 inches and the inner diameter of boss 30 is approximately 0.99 inches.

Means are also provided for engaging the top of the container 36 to the skirt 14. In the preferred embodiment, which is shown best in FIGS. 4–6, the dispenser engaging means is an annular boss 30 formed on the inner side of the bottom tier 18 near its base. Because of the inherent flexibility in the bottom tier 18, by pressing the device 10 onto the top of a container 36, the boss engages the bottom 35 of a container rim 34 to form a press fit. It is appreciated that the engaging means may instead take on any other suitable construction, such as a screw thread, for example.

In addition, a flexible claw 32 is also formed on the bottom of the shoulder 18A of the bottom tier 18. The claw is an annular curved member that extends inwardly from the bottom of the shoulder. When the container is engaged with the boss 30, the rim container top surface 37 comes into contact with the bottom surface 32a claw and flexes it slightly upward, thereby forming a seal with the top of the container rim to prevent liquid from exiting the side of the rim of the container.

If desired, a replaceable cap 40 may also be included to cover the dispenser and its spout 12 when liquid is not being dispensed, as shown in FIG. 6. The cap has first and second stacked, concentric tiers 42, 44. The first tier has a smaller radius and is adapted to be disposed about the spout, and the second tier is adapted to be disposed about the two-tiered skirt 14. An annular internal thread 46 is provided inside the bottom cap tier near its base, and is adapted to be screwed onto the container external threads 48. In addition, an annular recess 50 is provided near the base of the first tier 42, which is adapted to receive an annular boss 52 (FIGS. 4 and 5) formed on the outside of the top tier 16 of the skirt 14. This boss to recess engagement permits the cap and dispenser to be supplied as a unit and to be placed on the container as a unit. An annular wall 54 is sized to fit within the spout passageway 13 and contact the inner wall 13*a* of the spout passageway. The wall 54 extends from underneath the top of the cap to seal the spout passageway 13 when the cap is covering the dispenser 10.

Other embodiments of the principles of this invention are contemplated, and the appended claims are intended to cover such other embodiments as are within the scope and spirit of the invention.

I claim:

1. A dispenser adapted to dispense a viscous liquid from a container having a container opening at the container top, comprising:

a spout having an inner wall defining a fluid passageway terminating in a dispensing opening at one end of said spout;

a skirt bounding said spout opposite said one end, said skirt being adapted to be fitted to the top of the container to allow fluid passage between the container opening and said fluid passageway, an annular member extending annularly and opposite one end of said spout to form a bottomless bowl that has a diameter larger than said spout and that interconnects said fluid passageway to allow fluid flow between the fluid passageway and said bottomless bowl;

a rod extending through the center of said fluid passageway;

a relatively thin brace joining said rod to said spout inside said passageway, one edge of said brace being attached to said inner wall and the other edge of said brace being attached to said elongated rod; and said rod having one end portion above said brace and extending from said brace toward said dispensing opening and an other end portion below said brace extending from said brace into said bottomless bowl.

2. The dispenser of claim 1 wherein the diameter of said rod gradually decreases from said brace to each end of said rod to provide said rod with two tapered end portions.

3. The dispenser of claim 1 wherein said braces is generally rectangular and substantially shorter in length than said rod and the thickness of said brace is substantially less than the radius of said passageway, and said rod being generally cylindrical.

4. The dispenser of claim 1 wherein a transition from said spout to said bottomless bowl portion is by a curved surface formed at the base of said spout.

5. The dispenser of claim 4 wherein said curved surface formed at the base of said spout has a radius that ranges from about 0.010 to about 0.125 inches.

6. The dispenser of claim 4 further comprising a flexible claw member extending annularly around the inside of said skirt to engage the top of the container when said skirt is fitted on the container to cause said claw to flex upwardly and thereby prevent fluid from escaping from the side of said container.

7. The dispenser of claim 1 wherein said fluid passageway has a dispensing end, a fluid passageway opposite end, said bottomless bowl having one end connecting said bowl to said fluid passageway and an opposite bottomless bowl open end, and said rod other end portion extending from said brace beyond said bottomless bowl open end.

8. The dispenser of claim 7 wherein said brace is generally rectangular and substantially shorter in length than said rod and the thickness of said brace is substantially less than the radius of said passageway.

9. The dispenser of claim 7 wherein the diameter of said rod gradually decreases from said brace to each end of said rod to provide said rod with two tapered end portions.

10. The dispenser of claim 7 further comprising a flexible claw member extending annularly around the inside of said skirt to engage the top of the container when said skirt is fitted to the container to cause said claw to flex upwardly and thereby prevent fluid from escaping from the side of said container.

11. The dispenser of claim 7 wherein said skirt has a bottom and top tier with said spout being jointed to said top tier, a flexible claw member extending annularly around the inside of said skirt to engage the top of the container when said skirt is fitted on the container to cause said claw to flex upwardly and thereby prevent fluid from escaping from the side of said container.

12. The dispenser of claim 11 wherein said brace is generally rectangular and substantially shorter in length than said rod and wherein the thickness of said brace is substantially less than the radius of said passageway, and said rod gradually decreases from said brace to each end of said rod to provide said rod with two tapered end portions.

13. The dispenser of claim 12 wherein the dispenser is one-piece molded plastic dispenser.

14. A dispenser adapted to dispense a viscous liquid from a container having a container opening at the container top, comprising:

a spout having an inner wall defining a fluid passageway terminating in a dispensing opening at one end of said spout and a fluid passageway opposite end;

a skirt bounding said spout opposite said one end, said skirt being adapted to be fitted to the top of the container to allow fluid passage between the container opening and said fluid passageway, a rod extending through said fluid passageway and spaced from said inner wall; a relatively thin brace joining said rod to said spout inside said passageway, one edge of said brace being attached to said inner wall and the other edge of said brace being attached to said rod;

said rod having one end portion above said brace and extending from said brace toward said dispensing opening and a second end portion below said brace and extending from said brace into an area defined by said skirt.

15. The dispenser of claim 14 wherein said brace is generally rectangular and substantially shorter in length than said rod and the thickness of said brace is substantially less than the radius of said passageway, and said rod being generally cylindrical.

16. The dispenser of claim 14 wherein the diameter of said rod gradually decreases from said brace to each end of said rod to provide said rod with two tapered end portions.

17. The dispenser of claim 14 wherein said dispenser is a one-piece molded plastic dispenser.

18. A dispenser adapted to dispense a viscous liquid from a container having a container opening at the container top, comprising:

a spout having a fluid passageway terminating in a dispensing opening at one end of said spout;

a skirt bounding said spout opposite said one end, said skirt being adapted to be fitted to the top of the container to allow fluid passage between the container opening and said fluid passageway, an annular member extending annularly and opposite one end of said spout to form a bottomless bowl that has a diameter larger than said spout and that interconnects said fluid passageway to allow fluid flow between the fluid passageway and said bottomless bowl;

a rod extending through the center of said fluid passageway, said rod is generally cylindrical and each end of said rod is chamfered at an angle of about 45 degrees; and a relatively thin brace joining said rod to said spout inside said passageway.

19. The dispenser of claim 18 wherein said brace is generally rectangular, one longitudinal edge of said brace being attached to said inner wall and the other longitudinal edge being attached to said elongated rod.

20. The dispenser of claim 19 wherein said brace is substantially shorter in length than said elongated rod, and wherein the thickness of said brace is substantially less than the radius of said passageway.

21. The dispenser of claim 20 wherein the diameter of said rod gradually decreases from said brace to each end of said rod to define slopes in the surface of said rod.

22. The dispenser of claim 21 wherein the transition from said spout to said bottomless bowl portion is by a curved surface formed at the base of said spout having a radius that ranges from about 0.010 to about 0.125 inches.

23. The dispenser of claim 22 wherein said one end of said spout adjacent the dispensing opening is rounded.

24. The dispenser of claim 23 wherein said skirt comprises top and bottom tiers, said spout being joined to said top tier, said bottom tier being engagable with said container at said aperture.

25. The dispenser of claim 24 wherein an annular boss extends on the inside of said bottom tier, said boss being engagable with the top of said container.

26. The dispenser of claim 25 further comprising a flexible claw member extending annularly around said bottom tier underneath said top tier, engagement of the top of the container with the boss causing said claw to flex upwardly and thereby prevent fluid from escaping from the side of said container.

27. The dispenser of claim 26 wherein the radius of said bottomless bowl is approximately 0.26.

28. The dispenser of claim 27 further comprising a cap adapted to close said dispensing opening and means for engaging said cap to said dispenser.

29. The dispenser of claim 28 wherein said engaging means comprises a complimentary boss formed on said top tier of said skirt and an internal annular recess formed on said cap to receive said boss.

30. A one-piece plastic dispenser adapted to dispense a viscous liquid from a container having an opening at its top, said dispenser comprising:

a spout having a fluid passageway terminating in a dispensing opening at one end of said spout, said one end being rounded to allow smooth fluid flow;

a skirt bounding said spout opposite said one end adapted to be fitted to the top of the container to allow fluid passage between the opening and said fluid passageway, said skirt comprising top and bottom tiers, said spout being joined to said top tier, an annular boss extending on the inside of said bottom tier, said annular boss being engageable with the top of said container;

a flexible claw member extending annularly around said bottom tier underneath said top tier, engagement of the top of the container with said annular boss causing said claw to flex upwardly and thereby prevent fluid from escaping from the side of the top of said container;

a rod extending through the axial center of said fluid passageway, said rod being generally cylindrical and each end of said rod being chamfered;

a relatively thin brace joining said rod to said spout inside said passageway, said brace being generally rectangular, one longitudinal edge of said brace being attached to said inner wall and the other longitudinal edge being attached to said elongated rod, said brace being substantially shorter in length than said elongated rod and being centered along the length of said elongated rod, the thickness of said brace being substantially less than the radius of said passageway;

a curved member formed on the bottom of said skirt extending annularly opposite said spout to form a bottomless bowl interconnecting said fluid passageway to allow fluid flow between the fluid passageway and said bottomless bowl the outer edge of said bowl being chamfered;

a curved neck joining the bottomless bowl to the other end of said spout;

the diameter of said rod gradually decreases from said brace to each end of said rod to define slopes in the surface of said rod.

31. The dispenser of claim 29 wherein the diameter of said fluid passageway ranges from about 0.125 inches to about 0.500 inches.

32. The dispenser of claim 30 the cross-sectional area of said spout passageway ranges from about 0.015 square inches to about 0.25 square inches.

33. The dispenser of claim 29 wherein the surface area of said rod is about 25% to 50% of the surface area of the inner wall of said spout, and the cross-sectional area of said bowl at an open end is about 1.5 to 2.5 times a cross-sectional area of said spout passageway.

34. The dispenser of claim 30 wherein the radius of said curved neck ranges from 0.010 inches to 0.125 inches.

35. The dispenser of claim 29 wherein the radius of said bottomless bowl is about 0.260 inches.

* * * * *